US012578105B2

(12) United States Patent
Michaud

(10) Patent No.: US 12,578,105 B2
(45) Date of Patent: Mar. 17, 2026

(54) FRESH AIR INLET

(71) Applicant: Broan-NuTone LLC, Hartford, WI (US)

(72) Inventor: Stéphane Michaud, Drummondville (CA)

(73) Assignee: Broan-NuTone LLC, Hartford, WI (US)

( * ) Notice: Subject to any disclaimer, the term of this patent is extended or adjusted under 35 U.S.C. 154(b) by 385 days.

(21) Appl. No.: 18/297,910

(22) Filed: Apr. 10, 2023

(65) Prior Publication Data

US 2023/0324057 A1 Oct. 12, 2023

Related U.S. Application Data

(60) Provisional application No. 63/330,057, filed on Apr. 12, 2022.

(51) Int. Cl.

| | |
|---|---|
| ***F24F 7/06*** | (2006.01) |
| ***F24F 7/007*** | (2006.01) |
| ***F24F 13/08*** | (2006.01) |
| ***F24F 13/10*** | (2006.01) |
| *F24F 140/00* | (2018.01) |

(52) U.S. Cl.

CPC ..... *F24F 7/065* (2013.01); *F24F 7/007* (2013.01); *F24F 13/084* (2013.01); *F24F 13/10* (2013.01); *F24F 2140/00* (2018.01); *F24F 2221/22* (2013.01)

(58) Field of Classification Search

CPC ..... F24F 7/065; F24F 7/007; F24F 13/084; F24F 13/10; F24F 2140/00; F24F 2221/22

USPC ..... 454/254

See application file for complete search history.

(56) References Cited

U.S. PATENT DOCUMENTS

2022/0090806 A1* 3/2022 Grefsheim ..... F24F 11/63

FOREIGN PATENT DOCUMENTS

CN 214319495 U * 10/2021

OTHER PUBLICATIONS

ATC, 652 Series Multi-Function Multi-Range Timer, https://web.archive.org/web/20211018150143/https://atcdiversified.com/products/652-series-multi-function-multi-range-timer/, Oct. 18, 2021 (Year: 2021).*

* cited by examiner

*Primary Examiner* — Avinash A Savani
*Assistant Examiner* — Dana K Tighe
(74) *Attorney, Agent, or Firm* — Hansen Reynolds LLC

(57) ABSTRACT

An air inlet for an air handling unit includes a duct defining a passageway leading to the air handling unit. The fresh air inlet further includes an intake screen that is formed to include a plurality of openings sized to allow airflow to pass through the openings to the air handling unit. Accumulated particles are removed from surfaces of the intake screen with a screen cleaning system.

19 Claims, 7 Drawing Sheets

FRESH AIR INLET

PRIORITY CLAIM

This application claims priority under 35 U.S.C. § 119(e) to U.S. Provisional Application Ser. No. 63/330,057, filed Apr. 12, 2022, which is expressly incorporated by reference herein.

BACKGROUND

The present disclosure relates to an air inlet, and particularly to an air inlet that covers a hole in a wall of a building. More particularly, the present disclosure relates to an air inlet that covers a hole in an exterior wall of a building.

SUMMARY

In accordance with the present disclosure, an air inlet is included with a building structure having an air handling unit. The air inlet includes a duct mount configured to couple to a duct configured to direct air into the building structure. The duct has an opening defining an aperture which allows air to be withdrawn therethrough. The air inlet further includes an intake screen configured to span the duct aperture. The intake screen defines a plurality of openings sized to allow airflow to pass through the openings to the duct. In illustrative embodiments, the air inlet further includes a screen cleaning system coupled to at least one of the duct mount and the intake screen and configured to remove accumulated particles from surfaces of the intake screen surrounding the plurality of openings.

In illustrative embodiments, the screen cleaning system includes a brush configured to be in contact with the intake screen and a motor configured to rotate one of the intake screen and the brush relative to one another. In some embodiments, the motor is coupled to the brush and is configured to move the brush relative to the intake screen. In other embodiments, the brush is fixed in position relative to the duct mount and the motor is configured to move the intake screen relative to the brush.

In some embodiments, the air inlet further includes an actuator mount that extends from a first side of the intake screen to an opposite second side of the intake screen and the motor is coupled to the actuator mount to locate the actuator mount axially between the intake screen and the motor. The motor may include a drive shaft driven in rotation and the brush is coupled to the drive shaft for rotation relative to the intake screen about a central axis of the intake screen.

In some embodiments, the air inlet further includes a screen mount coupled to the intake screen. The motor may be configured to engage the screen mount and move the intake screen and the screen mount relative to the brush to remove the accumulated particles from the surfaces surrounding the plurality of openings. The screen mount may include a plurality of teeth that extend circumferentially around the intake screen and the motor is configured to rotate the intake screen relative to the screen cleaner about a central axis while the brush remains in a fixed position relative to the central axis. In some embodiments, the motor is offset from the central axis and the screen mount and includes a pinion having pinion teeth that mesh with the plurality of teeth included in the screen mount.

In some embodiments, the air inlet further includes a control system including a timer, a microprocessor, and a memory storage device storing instructions that, when executed by the microprocessor, cause the motor to activate in response to the timer reaching a predetermined threshold. The control system may be configured to stop airflow through the opening when the motor is activated. The control system may cause the motor to move the brush in a different direction each time the predetermined threshold is reached.

BRIEF DESCRIPTIONS OF THE DRAWINGS

DETAILED DESCRIPTION

Figure 1:
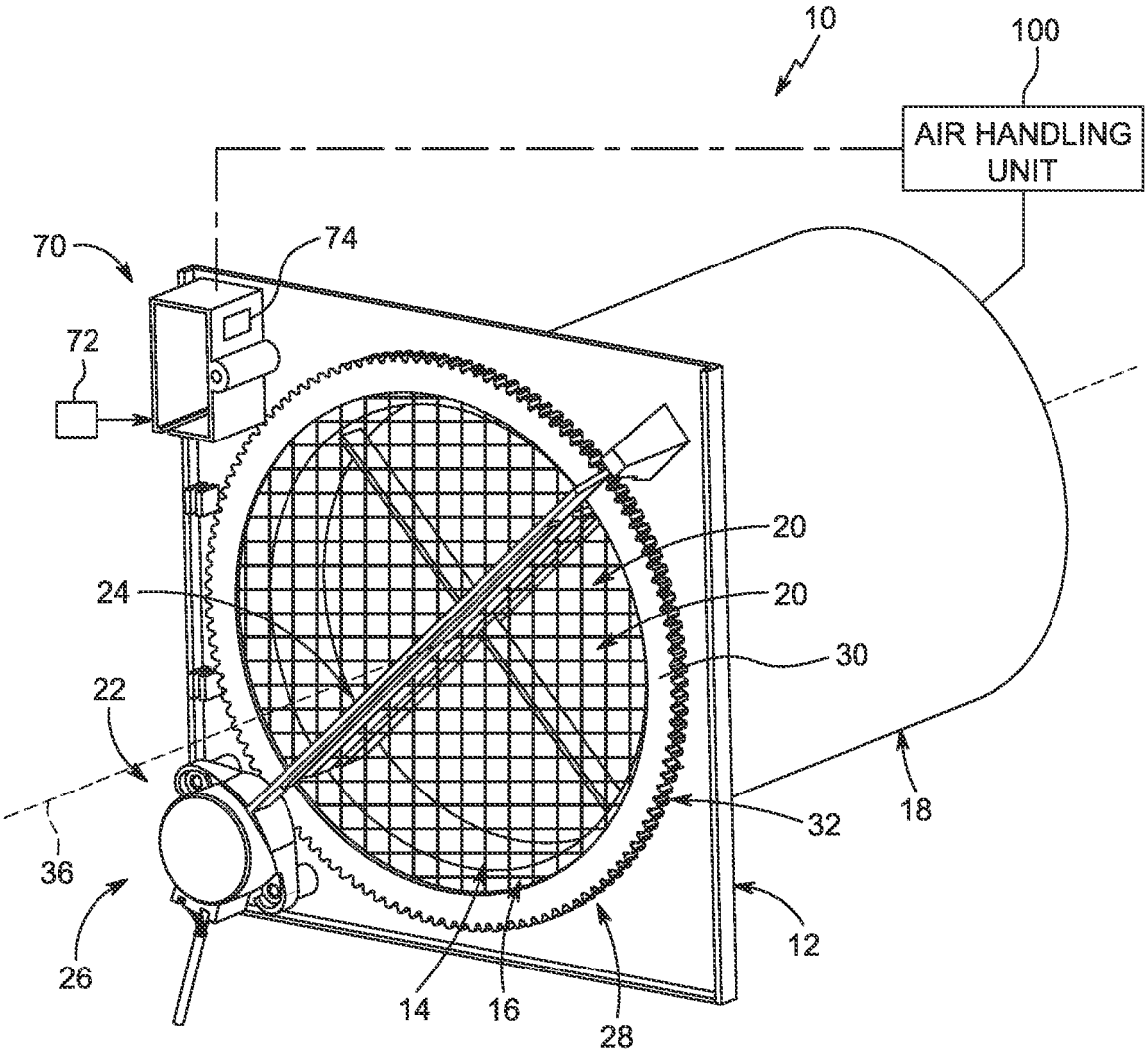
FIG. 1 is a perspective view of a fresh air inlet that is configured to be positioned in or adjacent to a hole in an exterior wall of a building and that includes an intake screen spanning the hole to block passage of relatively large objects.

An air inlet 10 is configured to be coupled to an air handling unit 100 and is configured to receive and direct an airflow to the air handling unit 100 as shown in FIG. 1 or other location. The air inlet 10 is illustratively embodied as an outdoor air inlet 10 for a fresh air system. The air inlet 10 is configured to be positioned in or adjacent to an opening or hole in an exterior wall of a building. The air handling unit 100 includes one or more fans that are configured to draw fresh air through the air inlet 10. The air inlet 10 covers the opening in the building to block relatively large objects, such as birds and/or insects, from passing through the air inlet 10 and reaching the air handling unit 100 and/or entering the building.

The air inlet 10 includes a duct mount 12 that is formed to define an aperture 14 and an intake screen 16 that is sized to span the aperture 14 as shown in FIG. 1. The duct mount 12 may have any shape, but, in the illustrative embodiment, has a square shape and is configured to mount to a duct 18 that leads to the air handling unit 100. The duct mount 12 may couple to the duct 18 or another structure around the duct 18 (i.e. the building) and positions the intake screen 16 relative to the duct 18. The aperture 14 formed in the duct mount 12 is circular in shape to match a shape of the duct 18, but, in other embodiments, may have a different shape (i.e. square or rectangular). The intake screen 16 also has a circular shape that corresponds with the aperture 14. The intake screen 16 has a diameter that is greater than or equal to a diameter of the aperture 14 to extend all the way across the aperture 14. The intake screen 16 is illustratively embodied as a mesh screen and defines a plurality of openings 20 that are smaller than the aperture 14 to block large objects (e.g. objects greater than about a cubic millimeter) from entering the duct 18. In some embodiments, the duct mount 12 may be omitted and the intake screen 16 is attached directly to the duct 18 or the building. In some embodiments, the intake screen 16 may be a dual or tandem screen that includes multiple openings for fresh air and exhaust air.

The air inlet 10 further includes a screen cleaning system 22 that is configured to remove accumulated particles from surfaces of the intake screen 16 surrounding the plurality of openings 20 as shown in FIG. 1. The screen cleaning system 22 may operate automatically or in response to a user input 72 that activates the screen cleaning system 22. Once activated, the screen cleaning system 22 may operate continuously or in intervals to remove from the intake screen 16 any debris such as dust, plant matter, lint, water, ice, or any other type of debris that may attach to or get caught in the intake screen 16.

The screen cleaning system 22 includes a screen cleaner 24 positioned to engage the surfaces of the intake screen 16 surrounding the openings 20 and an actuator 26 coupled to the screen cleaner 24 as shown in FIG. 1. The screen cleaner 24 is illustratively embodied as a brush, although, other devices or structures may be used in place of or in addition to the brush such as a scrapper, a foam, a natural or synthetic cloth, etc. The actuator 26 is configured to drive the intake screen 16 and/or the screen cleaner 24 relative to one another so that the screen cleaner 24 removes the accumulated debris from the surfaces of the intake screen 16 allowing airflow to carry the debris away from the intake screen 16. The actuator 26 may be coupled directly to the screen cleaner 24, to the intake screen 16, or to an intermediate structure as will be described below.

As shown in the embodiment of FIGS. 1-5, the screen cleaner 24 is fixed relative to the duct mount 12 and the screen cleaning system 22 further includes screen mount 28 coupled to the intake screen 16. The screen mount 28 is configured to support the intake screen 16 relative to the aperture 14 in the duct mount 12. The actuator 26 is configured to engage the screen mount 28 and move the intake screen 16 and the screen mount 28 relative to the screen cleaner 24 to remove the accumulated particles from the surfaces surrounding the plurality of openings 20.

Figure 2:
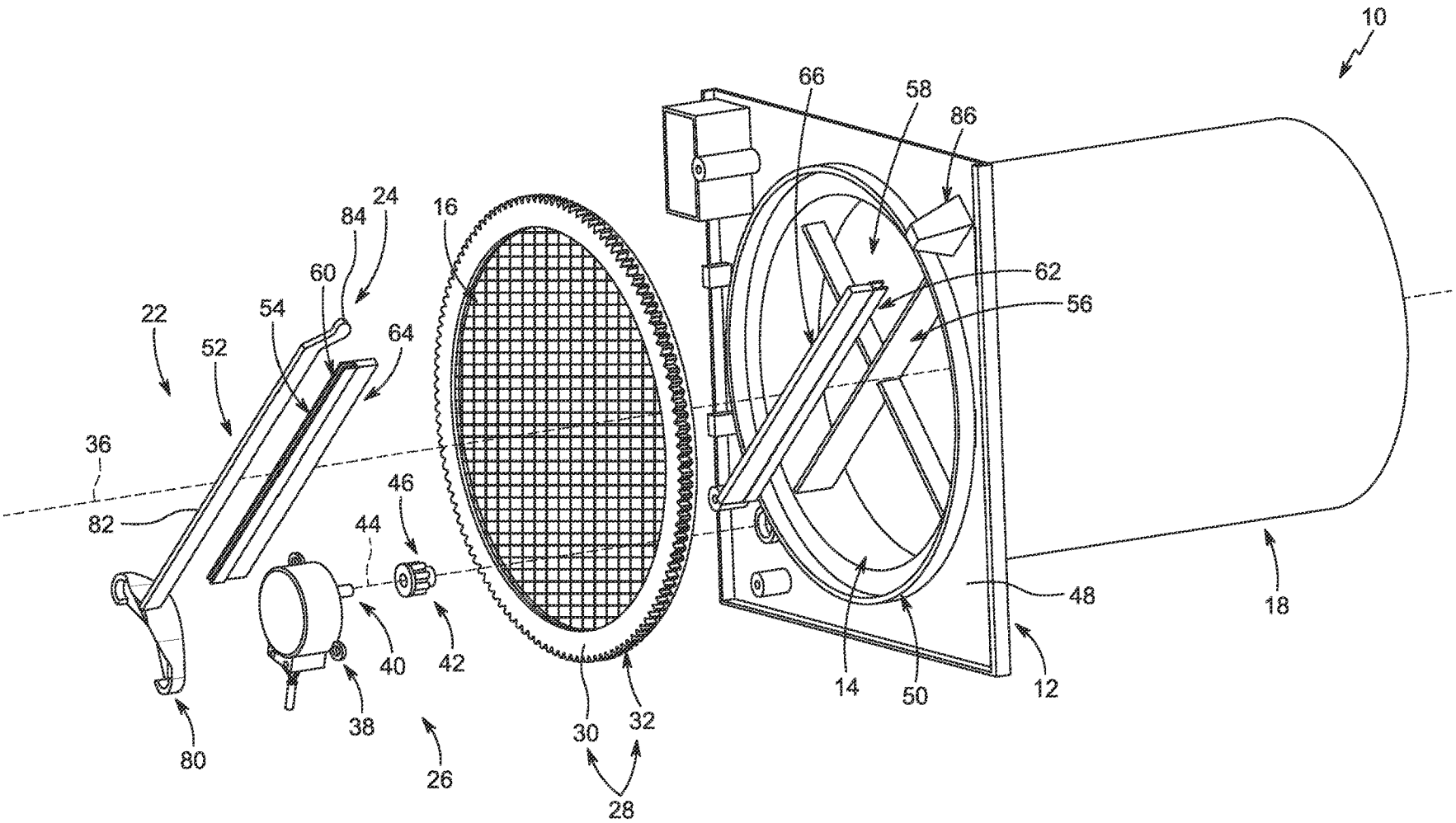
FIG. 2 is an exploded view of the fresh air inlet from FIG. 1 showing that the air inlet further includes a duct mount to which the intake screen attaches and a screen cleaning system that removes debris from the intake screen.

The intake screen 16 may be overmolded with the screen mount 28 or coupled to the screen mount 28 with an adhesive or one or more mechanical devices, such as a staple, pin, nail, screw, tie, etc. The screen mount 28 includes a mount body 30 and a plurality of teeth 32 extending from the mount body 30 as shown in FIGS. 1 and 2. The mount body 30 defines a circular ring that extends around a central axis 36 and is generally planar with the intake screen 16. The plurality of teeth 32 extend from a radially outer surface of the mount body 30 and extend circumferentially around the central axis 36. The plurality of teeth 32 extend radially away from the mount body 30 to interact with the actuator 26. In some embodiments, the teeth 32 may be omitted and the screen mount can be rotated by one or more of friction drum(s), pulley with straps, worm & gear drive, lever with connecting rod, etc.

The actuator 26 is configured to rotate the screen mount 28 (and, hence, the intake screen 16) relative to the screen cleaner 24 about the central axis 36. An outer surface of the mount body 30 extends parallel with the central axis 36 to define an axial thickness that is greater than an axial thickness of the plurality of teeth 32. Because of this thickness difference, a portion of the radially outer surface of the mount body 30 is coupled in rotative-bearing engagement with surfaces of the duct mount 12 around the aperture 14. These surfaces support the screen mount 28 and the intake screen 16 on the duct mount 12 so that the intake screen 16 can rotate relative to the duct mount 12 and the screen cleaner 24. In other embodiments, the actuator 26 can be a piston or solenoid, a portion of which is driven linearly to move the screen mount 28.

Figure 4:
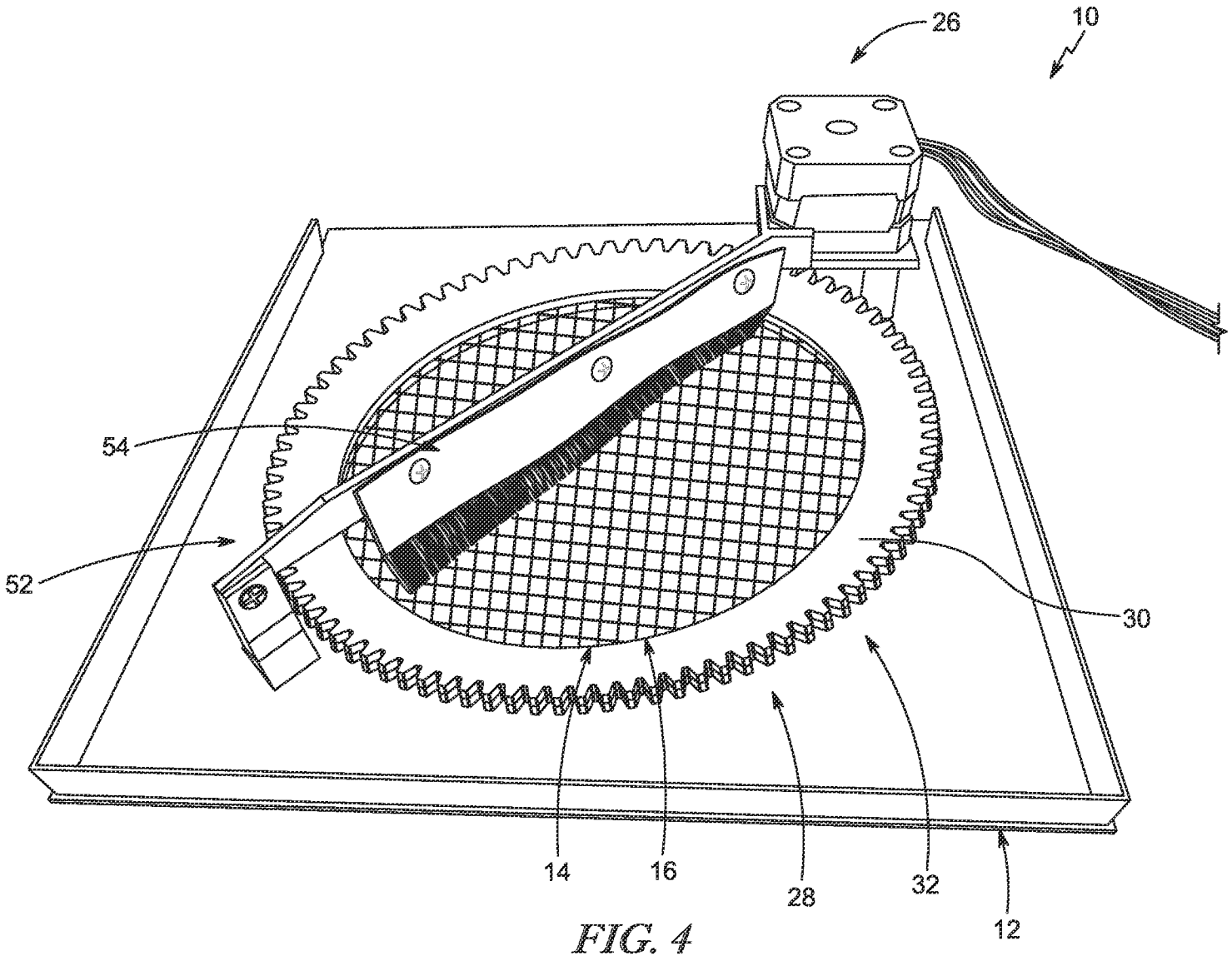
FIG. 4 is another perspective view of the fresh air inlet of FIG. 1.
Figure 5:
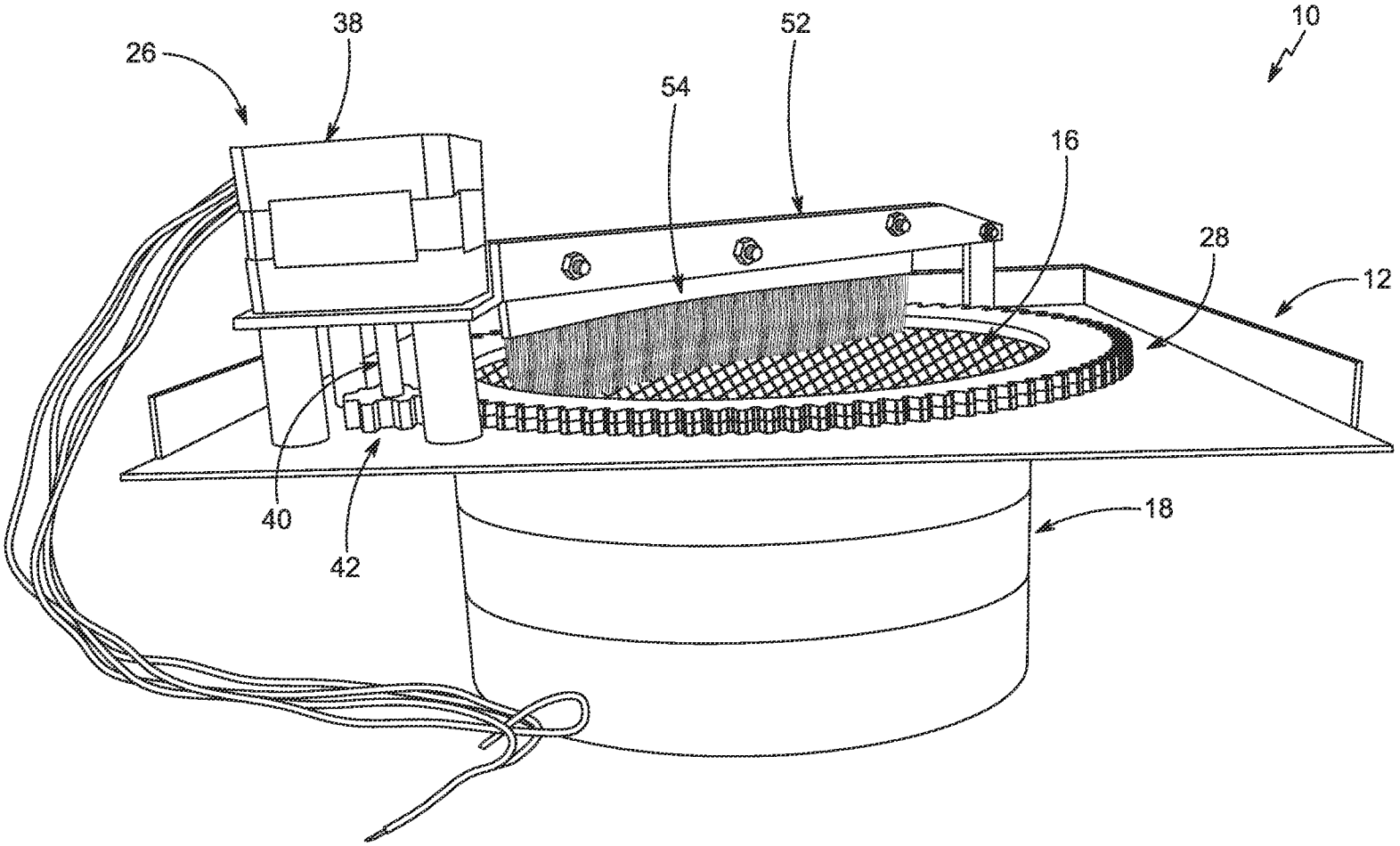
FIG. 5 is another perspective view of the fresh air inlet of FIG. 1.

The actuator 26 is offset from the central axis 36 and the screen mount 28. The actuator 26 in the illustrative embodiment is electrically powered and includes a motor 38, a drive shaft 40, and a pinion 42 as shown in FIGS. 2 and 4. The motor 38 may be brushed or brushless and can be powered by alternating current or direct current. The motor 38 may be coupled directly to the air handling unit 100 to receive power therefrom and to exchange operating signals therebetween. The drive shaft 40 is coupled to the motor and driven in rotation by the motor 38 about a pinion rotation axis 44. The pinion 42 is coupled to a distal end of the drive shaft 40 and includes pinion teeth 46 that mesh with the plurality of teeth 32 included in the screen mount 28. The drive shaft 40 is configured to rotate the pinion 42 about the pinion rotation axis 44 so that the pinion teeth 46 drive the screen mount 28 and the intake screen 16 to rotate about the central axis 36 owing to the meshed engagement of teeth 32 and teeth 44.

The duct mount 12 includes a mount plate 48 and a screen retainer ring 50 extending from the mount plate 48. The mount plate 48 is configured to attach to at least one of the duct 18 and structures of the building surrounding the duct 18 to locate the intake screen 16 relative to the aperture 14. The screen retainer ring 50 extends away from the mount plate 48 and cooperates with portions of the mount plate 48 to provide a pocket which receives the mount body 30 of the screen mount 28. Portions of the radially outer surface of the mount body 30 engage the screen retainer ring 50 to place the screen mount 28 in rotative-bearing engagement with the screen retainer ring 50. The mount body 30 and the screen retainer ring 50 are made from one or more polymeric materials having a low-friction interaction with one another. Thus, no bearings may be needed between the mount body 30 and the screen retainer ring 50. However, in other embodiments, bearings or a low-friction coating or lubrication may be used between the mount body 30 and the screen retainer ring 50.

Figure 3:
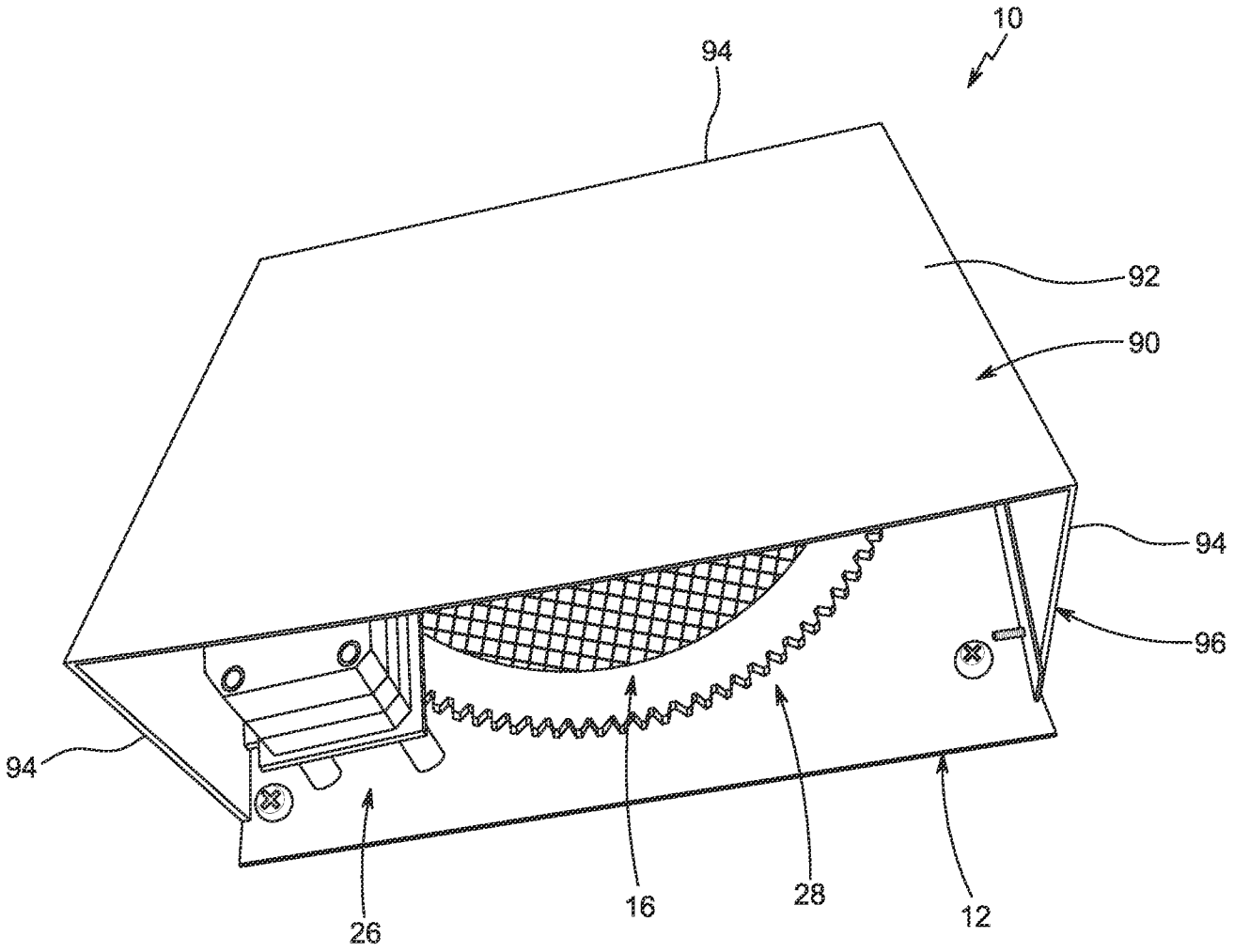
FIG. 3 is a perspective view of the fresh air inlet of FIG. 1 further including a cover mounted on the duct mount.

In some embodiments, the duct mount 12 further includes a cover 90 that is mounted to a perimeter of the mount body 48 as shown in FIG. 3. The cover 90 includes a front wall 92 spaced apart from the intake screen 16 and the mount body 48 and a plurality of side walls 94 extending between and interconnecting the mount body 48 and the front wall 92. At least one side of the cover 90 has no side wall 94 to provide an opening 96 that allows passage of air to the intake screen 16.

The screen cleaner 24 includes a first cleaner mount 52 and a first brush 54 fixed to the cleaner mount 52 as shown in FIGS. 1 and 2. The cleaner mount 52 is coupled to the mount plate 48 of the duct mount 12 and traverses the aperture 14 to position the first brush 54 over and in contact with the intake screen 16. The cleaner mount 52 may be coupled to other structures surrounding the duct mount 12 such as the duct 18 or structures of the building. The first brush 54 is supported relative to the intake screen 16 by the cleaner mount 52 so that the first brush 54 removes debris from the intake screen 16 as the intake screen 16 is moved by the actuator 26.

In the illustrative embodiment, the screen cleaner 24 further includes a second cleaner mount 56 and a second brush 58 as shown in FIGS. 1 and 2. The second cleaner mount 56 and the second brush 58 are positioned on an opposite side of the intake screen 16 as the first cleaner mount 52 and the first brush 54. The second cleaner mount 56 is coupled to at least one of the duct mount 12 and the duct 18 downstream of the intake screen 16. The first brush 54 and the second brush 58 are arranged in the same angular orientation relative to the intake screen 16 and the central axis 36 but could be oriented differently in other embodiments.

Both brushes 54, 58 are fixed relative to the intake screen 16 and the screen mount 28 but are removable from their respective cleaner mount 52, 56 as shown in FIG. 2. Each brush 54, 58 includes a brush clip 60, 62 and a plurality of bristles 64, 66. The brush clips 60, 62 may be elastically deformable to grip on the each respective cleaner mount 52, 56 to retain the first and second brushes 54, 58 relative to the intake screen 16. The plurality of bristles 64, 66 are configured to engage the intake screen 16 to remove debris when the intake screen 16 is rotated by the actuator 26. In some embodiments, the brush clips 60, 62 may be omitted and the brushes 54, 58 may be attached with any suitable fastener (e.g. a screw) or by friction interference in a slot (not shown), for example.

Various components of the air inlet 10 may cooperate together to decrease the amount of components included in air inlet 10 or provide reinforcement for certain components, for example. For instance, the actuator 26 may be mounted to the duct mount 12 using a portion of the cleaner mount 52 as shown in FIGS. 1-4. The cleaner mount 52 includes a motor mount 80, a brush mount 82, and a retainer arm 84. The motor mount 80 is configured to mount the motor and the cleaner mount 52 to the duct mount 12 together using a pair of fasteners, for example. The brush mount 82 extends across the aperture 14 away from the motor mount 80 toward a diametrically opposite side of the aperture 14 from the actuator 26. The brush 54 is coupled to the brush mount 82 to be positioned over the intake screen 16. The retainer arm 84 is received in a retainer arm hub 86 formed on the duct mount 12 on the opposite side of the aperture 14 to the actuator 26 and the motor mount 80.

As shown in FIG. 1, the screen cleaning system 22 may further include a control system 70 that is configured to operate the screen cleaning system 22. The control system 70 includes one or more microprocessors, one or more memory storage devices, and circuitry interconnecting the microprocessor, memory storage device, the actuator 26, and/or the air handling unit 100. The memory storage device stores instructions that, when executed by the microprocessor, cause the actuator 26 to activate and rotate/move the intake screen 16 for cleaning. The control system 70 may cause the actuator 26 to activate in response to a user input 74, such as a closed switch or a pressed button on a control panel or touchscreen coupled to the air handling unit 100, the air inlet 10, anywhere on or around the building. User inputs may also be made wirelessly by a remote control (i.e. smart phone, tablet, laptop, etc.) and transmitted to the control system 70 via the circuitry included therein (i.e. one or more transceivers, Bluetooth modules, Wifi modules, etc.).

The control system 70 may also cause the air handling unit 100 to perform a function in response to the user input. For example, the control system 70 may cause a fan included in the air handling unit 100 to deactivate temporarily as the actuator 26 rotates the intake screen 16. In this way, debris can be removed without being drawn into the air handling unit 100. A filter (not shown) can be included in the air handling unit 100 to capture debris. The control system 70 may cause the air handling unit 100 to continue operating while debris is being removed from the intake screen 16 so that the removed debris is transferred to and captured by the filter and is easily accessible by a user for cleaning/replacement.

The control system 70 may cause the actuator 26 to operate continuously in some embodiments. In other embodiments, the control system 70 includes a timer 72 and the control system 70 causes the actuator 26 to activate and/or operate based on one or more predetermined time thresholds without any user inputs (i.e. automatically). For example, the control system 70 may activate the actuator 26 every time the timer 72 reaches a first predetermined threshold (i.e. 30 minutes). The control system 70 can then monitor the timer and cause the actuator 26 to deactivate after a second predetermined amount of time is reached after the actuator 26 was activated (i.e. 2 minutes). Thus, the intake screen 16 can be periodically cleaned using the control system 70 and the timer 72. In some embodiments, the actuator 26 or the intake screen can be monitored and the control system 70 can activate or deactivate the actuator 26 in response to a status of the intake screen (i.e. the presence or lack of a predetermined amount of debris). The first and second predetermined thresholds may be set to any integer value and stored in the memory storage device. The control system 70 may cause the actuator 26 to rotate about pinion axis 44 in a different direction at each activation of the actuator 26. In this way, the control system 70 may minimize build-up of debris on the screen cleaner 24 and improve airflow through intake screen 16. In some embodiments, the actuator 26 can be powered by a battery and/or solar panel array (not shown).

Figure 6:
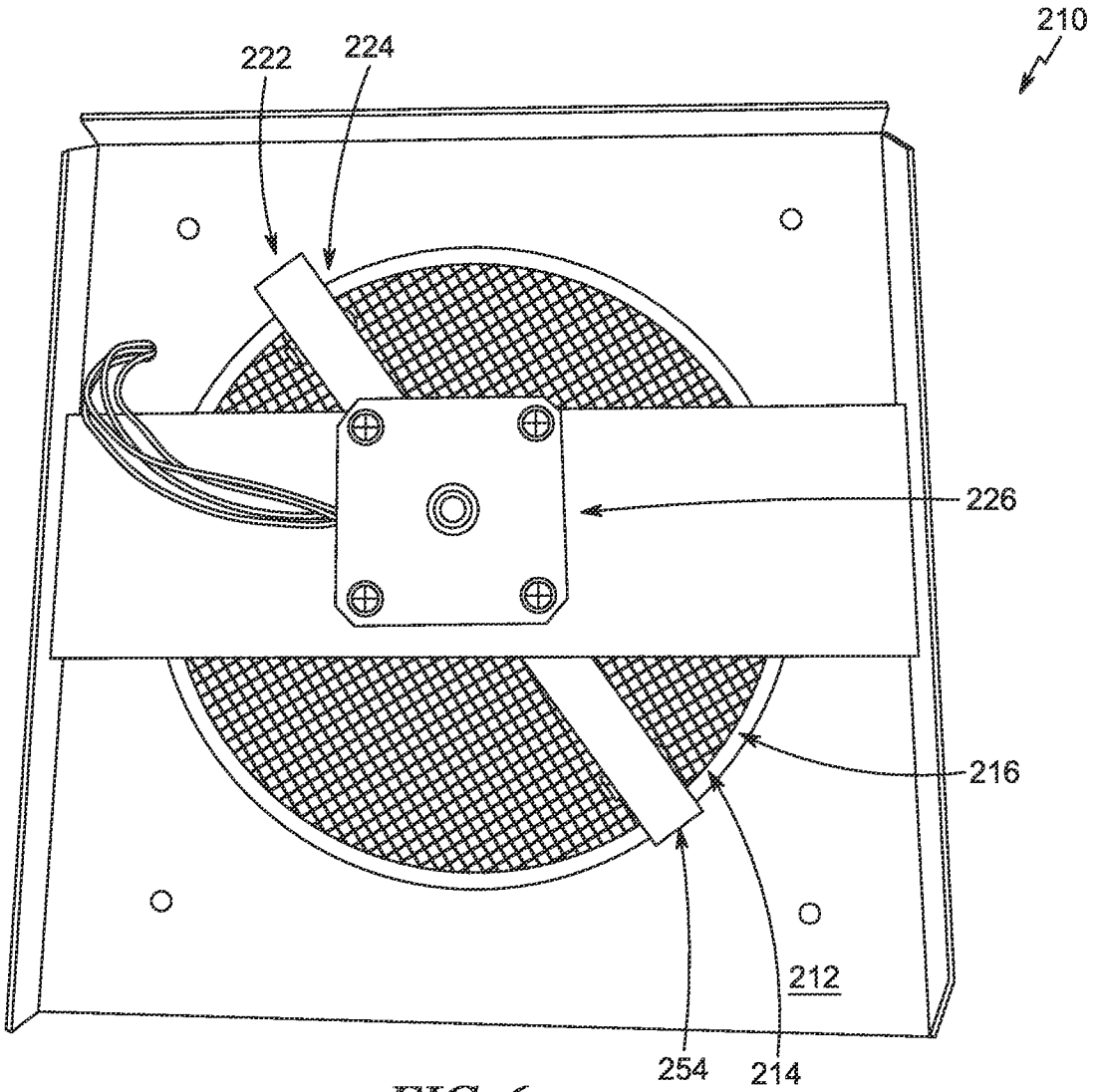
FIG. 6 is a front view of another embodiment of a fresh air inlet including a screen cleaning system.
Figure 7:
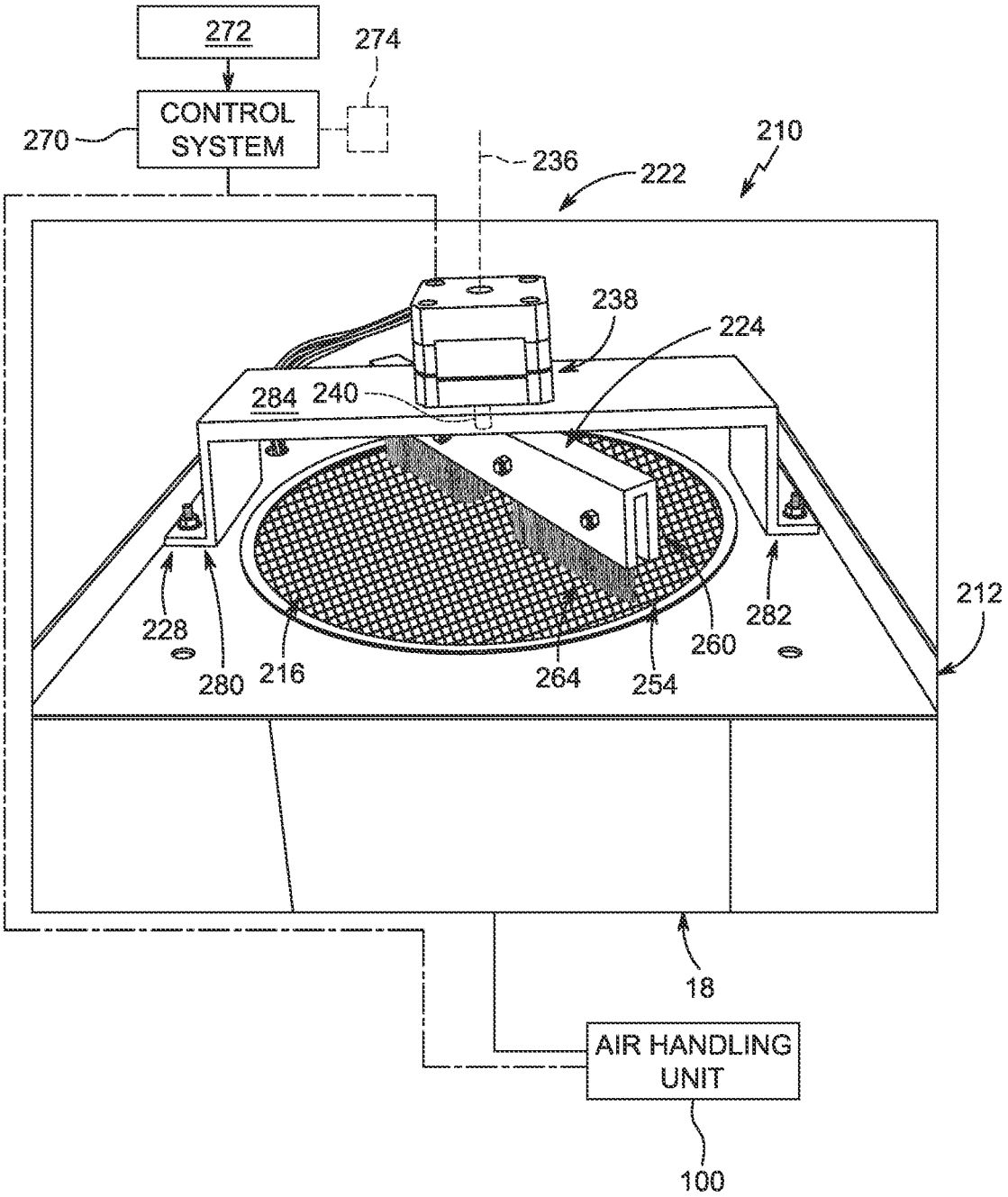
FIG. 7 is another perspective view of the fresh air inlet of FIG. 6.

Another embodiment of a screen cleaning system 222 that can be used to clean an intake screen 216 of an air inlet 210 similar to air inlet 10 is shown in FIGS. 6 and 7. The disclosure of air inlet 10 is incorporated by reference for air inlet 210 and various differences between air inlet 210 and air inlet 10 are described below.

In the embodiment show in FIGS. 6 and 7, the intake screen 216 is fixed to the duct 18 or to another structure surrounding an aperture 214 formed in duct mount 212 leading in to the duct 18. Thus, the intake screen 216 does not move relative to the duct 18. The screen cleaning system 222 includes a screen cleaner 224 positioned to engage the surfaces of the intake screen 216 surrounding openings 220 formed in the intake screen and an actuator 226 coupled to the screen cleaner 224. The actuator 226 is coupled directly to the screen cleaner 224 and is configured to move the screen cleaner 224 relative to the intake screen 216. In some embodiments, the actuator 226 is indirectly coupled to the screen cleaner 224 by a pulley and strap(s), one or more gears, etc.

The screen cleaning system 222 further includes an actuator mount 228 that extends from a first side of the intake screen 216 to an opposite second side of the intake screen 216. The actuator 226 is coupled to the actuator mount 228 to locate the actuator mount 228 axially between the intake screen 216 and the actuator 226.

The actuator 226 may be aligned with a central axis 236 of the intake screen 216. The actuator 226 in the illustrative embodiment is electrically powered and includes a motor 238 and a drive shaft 240 as shown in FIGS. 6 and 7. The motor 238 may be brushed or brushless and can be powered by alternating current or direct current. The motor 238 may be coupled directly to the air handling unit 100 to receive power therefrom and to exchange operating signals therebetween. The drive shaft 240 is coupled to the motor and driven in rotation by the motor 238 about the central axis 236. The drive shaft 240 is configured to rotate the screen cleaner 224 about the central axis 236 to remove debris from the intake screen 216. In other embodiments, the actuator 226 may be a linear actuator and may drive the screen cleaner 224 back and forth along the intake screen 216 to remove debris.

The screen cleaner 224 includes a brush 254 coupled to the drive shaft 240 of the actuator 226 as shown in FIG. 7. The brush 254 is supported relative to the intake screen 216 by the drive shaft 240 so that the brush 254 removes debris from the intake screen 216 as the brush 254 is moved by the actuator 226.

The brush 254 is movable relative to the intake screen 216 and the screen mount 228 and is removable from the cleaner mount 252 as shown in FIG. 7. The brush 254 includes a brush clip 260 and a plurality of bristles 264. The brush clip 260 may be elastically deformable and may grip the cleaner mount 252 to retain the brush 254 relative to the intake screen 216. The plurality of bristles 264 are configured to engage the intake screen 216 to remove debris when the brush 254 is rotated by the actuator 226.

The actuator mount 228 includes a first support 280, a second support 282 spaced apart from the first support 280, and a motor holder 284 that extends between and interconnects the first support 280 and the second support 282 as shown in FIG. 7. The first support 280 and the second support 282 are fixed to the duct mount 212 on opposite sides of the aperture 214 from one another. At least a portion of each support 280, 282 extends away from the duct mount 212 and the aperture 214. The motor holder 284 is coupled to distal ends of each support 280, 282 such that the motor holder 284 is spaced apart axially from the aperture 214 and the intake screen 216 spanning the aperture 214 so that no part of the motor holder 284 substantially obscures the aperture 214.

The motor 238 is fixed to an upstream side of the motor holder 284. The drive shaft 240 passes axially through the motor holder 284 from the upstream side of the motor holder 284 to a downstream side of the motor holder 284. Thus, the motor 238 is positioned upstream of the motor holder 284 and away from the aperture 214 so as not to significantly block any air flow through the aperture 214. The screen cleaner 224 is located axially between the motor holder 284 and the intake screen. The screen cleaner 224 and/or the drive shaft 240 has a length sufficient to position the plurality of bristles 264 directly in contact with the intake screen 216.

As shown in FIG. 7, the screen cleaning system 222 may further include a control system 270 that is configured to operate the screen cleaning system 222. The control system 270 includes one or more microprocessors, one or more memory storage devices, and circuitry interconnecting the microprocessor, memory storage device, the actuator 226, and/or the air handling unit 100. The memory storage device stores instructions that, when executed by the microprocessor, cause the actuator 226 to activate and move the screen cleaner 224 to clean the intake screen 216. The control system 270 may cause the actuator 226 to activate in response to a user input 272, such as a closed switch or a pressed button on a control panel or touchscreen, or wirelessly as previously described.

The control system 270 may also cause the air handling unit 100 to perform a function in response to the user input. For example, the control system 270 may cause a fan included in the air handling unit 100 to deactivate temporarily as the actuator 226 moves the screen cleaner 224. In this way, debris can be removed from the intake screen 216 without the debris being drawn into the air handling unit 100 where it could affect the performance of the air handling unit 100. The control system 270 may cause the air handling unit 100 to continue operating while debris is being removed from the intake screen 216 so that the removed debris is transferred to and captured by the filter and is easily accessible by a user for cleaning/replacement.

In some embodiments, the control system 270 includes a timer 274 and the control system 270 causes the actuator 226 to activate and/or operate based on one or more predetermined time thresholds. For example, the control system 270 may activate the actuator 226 every time the timer reaches a first predetermined threshold (i.e. 30 minutes). The control system 270 can then monitor the timer 274 and cause the actuator 226 to deactivate after a second predetermined amount of time is reached after the actuator 26 was activated (i.e. 2 minutes). Thus, the intake screen 216 can be periodically cleaned using the control system 270 and the timer 274. In some embodiments, the actuator 226 or the intake screen can be monitored and the control system 270 can activate or deactivate the actuator 226 in response to a status of the intake screen 216 (i.e. the presence or lack of a predetermined amount of debris). In some embodiments, the actuator 26 can be powered by a battery and/or solar panel array (not shown).

The present disclosure is related to fresh air inlet transitions that get installed in the exterior of a home and connect to the inlet duct of a fresh air system or air handling unit. The air inlet may be installed in a hole in a wall to a building. The air inlet includes a bird screen (i.e. an intake screen) which may include up to 0.5 square inch openings, ⅛ square inch openings, ¼ square inch openings, or any other size openings. Some screens may collect debris on surfaces surrounding or defining the openings as air passes therethrough.

In some embodiments, the air inlet is self-cleaning. The air inlet may include a motorized brush or motorized mesh screen that is used to sweep/clean debris off the mesh screen. The motor may be programmed to operate continuously or in intervals to remove or limit debris from the mesh screen. In some embodiments, the unit air inlet includes a gear that is overmolded on the screen. The gear and screen may form a unit that can be removed and replaced. In some embodiments, brushes are placed on both sides of the screen to clean the grill. In some embodiments, only one brush is used and is placed on only one side of the screen. In some embodiments, each brush is also removable and replaceable.

In some embodiments, the actuator is operated for about 2 minutes every 30 minutes to reduce dust build-up, save energy, and provide longer motor life. In some embodiments, the duct mount 12 could be connected to a straight duct section or an elbow duct for a soffit application. In some embodiments, air inlet can include a different metal cap or plastic cap over the intake screen to offer different models, orientation, and colors. In some embodiments, the control system can change the rotation direction at every start to reduce dust build-up on the brushes. The air inlet 10 can be formed with various manufacturing additives (molded in or coated) to decrease surface friction of the surfaces of the air inlet 10 and block debris from adhering to the surfaces. These additives may include: anti-static (cationic antistatic additives), Teflon coatings (i.e. PTFE—Polytetrafluoroethylene), silicone coatings, ceramic coatings (Sol-gel), etc.

The invention claimed is:

1. An air inlet for a building structure having an air handling unit, the air inlet comprising:

a duct mount configured to couple to a duct configured to direct air into the building structure, the duct comprising an opening defining an aperture;

an intake screen configured to span the duct aperture, the intake screen defining a plurality of openings sized to allow airflow to pass through the plurality of openings to the duct; and a screen cleaning system coupled to at least one of the duct mount and the intake screen and configured to remove accumulated particles from surfaces of the intake screen surrounding the plurality of openings, wherein the screen cleaning system comprises a screen cleaner positioned to engage the surfaces of the intake screen surrounding the openings, an actuator configured to drive at least one of the intake screen and the screen cleaner relative to one another so that the screen cleaner removes the accumulated particles from the surfaces of the intake screen surrounding the plurality of openings, and a screen mount coupled to the intake screen and wherein the actuator is configured to engage the screen mount and move the intake screen and the screen mount relative to the screen cleaner to remove the accumulated particles from the surfaces surrounding the plurality of openings.

2. The air inlet of claim 1, wherein the actuator is coupled directly to the screen cleaner and is configured to move the screen cleaner relative to the intake screen.

3. The air inlet of claim 2, wherein the screen cleaning system further includes an actuator mount that extends from a first side of the intake screen to an opposite second side of the intake screen and the actuator is coupled to the actuator mount to locate the actuator mount axially between the intake screen and the actuator.

4. The air inlet of claim 3, wherein the actuator includes a motor and a drive shaft driven in rotation by the motor and the screen cleaner is coupled to the drive shaft for rotation relative to the intake screen about a central axis of the intake screen.

5. The air inlet of claim 1, wherein the screen mount includes a plurality of teeth that extend circumferentially around the intake screen and the actuator is configured to rotate the intake screen relative to the screen cleaner about a central axis.

6. The air inlet of claim 5, wherein the actuator includes a motor that is offset from the central axis and the screen mount and a pinion having pinion teeth that mesh with the plurality of teeth included in the screen mount.

7. The air inlet of claim 1, wherein the screen cleaner includes a first brush positioned on a first side of the intake screen.

8. The air inlet of claim 7, wherein the screen cleaner further includes a second brush positioned on a second side of the intake screen opposite the first side.

9. An air inlet for a building structure having an air handling unit, the air inlet comprising:

a duct mount configured to couple to a duct configured to direct air into the building structure, the duct comprising an opening defining an aperture;

an intake screen configured to span the duct aperture, the intake screen defining a plurality of openings sized to allow airflow to pass through the plurality of openings to the duct; and a screen cleaner configured to be in contact with the intake screen;

a motor configured to rotate one of the intake screen and the brush relative to one another; and a screen mount coupled to the intake screen and wherein the motor is configured to engage the screen mount and move the intake screen and the screen mount relative to the screen cleaner to remove the accumulated particles from the surfaces surrounding the plurality of openings.

10. The air inlet of claim 9, wherein the motor is coupled to the screen cleaner and is configured to move the screen cleaner relative to the intake screen.

11. The air inlet of claim 10, further comprising an actuator mount that extends from a first side of the intake screen to an opposite second side of the intake screen and the motor is coupled to the actuator mount to locate the actuator mount axially between the intake screen and the motor.

12. The air inlet of claim 11, wherein the motor includes a drive shaft driven in rotation and the screen cleaner is coupled to the drive shaft for rotation relative to the intake screen about a central axis of the intake screen.

13. The air inlet of claim 9 wherein the screen mount includes a plurality of teeth that extend circumferentially around the intake screen and the motor is configured to rotate the intake screen relative to the screen cleaner about a central axis while the screen cleaner remains in a fixed position relative to the central axis.

14. The air inlet of claim 13, wherein the motor is offset from the central axis and the screen mount and includes a pinion having pinion teeth that mesh with the plurality of teeth included in the screen mount.

15. The air inlet of claim 9, further comprising a control system including a timer, a microprocessor, and a memory storage device storing instructions that, when executed by the microprocessor, cause the motor to activate in response to the timer reaching a predetermined threshold.

16. The air inlet of claim 15, wherein the control system is configured to stop airflow through the opening when the motor is activated.

17. The air inlet of claim 15, wherein the control system causes the motor to move the screen cleaner in a different direction each time the predetermined threshold is reached.

18. An air inlet for a building structure having an air handling unit, the air inlet comprising:

a duct mount configured to couple to a duct configured to direct air into the building structure, the duct comprising an opening defining an aperture;

an intake screen configured to span the duct aperture, the intake screen defining a plurality of openings sized to allow airflow to pass through the openings to the duct; and a screen cleaning system coupled to at least one of the duct mount and the intake screen and configured to remove accumulated particles from surfaces of the intake screen surrounding the plurality of openings, wherein the screen cleaning system comprises a screen cleaner positioned to engage the surfaces of the intake screen surrounding the openings, a first brush positioned on a first side of the intake screen, a second brush positioned on a second side of the intake screen opposite the first side.

19. An air inlet for a building structure having an air handling unit, the air inlet comprising:

a duct mount configured to couple to a duct configured to direct air into the building structure, the duct comprising an opening defining an aperture;

an intake screen configured to span the duct aperture, the intake screen defining a plurality of openings sized to allow airflow to pass through the openings to the duct;

a screen cleaner configured to be in contact with the intake screen;

a motor configured to rotate one of the intake screen and the screen cleaner relative to one another;

a control system including a timer, a microprocessor, and a memory storage device storing instructions that, when executed by the microprocessor, cause the motor to activate in response to the timer reaching a predetermined threshold, wherein the control system is configured to stop airflow through the opening when the motor is activated.

* * * * *